United States Patent [19]

Phillips

[11] 4,334,707

[45] Jun. 15, 1982

[54] GOLF BALL RETRIEVER

[76] Inventor: Chester S. Phillips, 19 Claire Ct., Florissant, Mo. 63031

[21] Appl. No.: 206,834

[22] Filed: Nov. 14, 1980

Related U.S. Application Data

[63] Continuation of Ser. No. 9,862, Feb. 7, 1979, abandoned.

[51] Int. Cl.[3] ..... A63B 47/02

[52] U.S. Cl. ..... 294/19 A

[58] Field of Search ..... 294/19 A, 20, 99 R; 56/328 R, 332; 273/32 F, 162 E

[56] References Cited

U.S. PATENT DOCUMENTS

| | | | |
|---|---|---|---|
| 560,592 | 5/1896 | Main | 294/20 X |
| 809,985 | 1/1906 | Rundberg | 294/20 |
| 1,993,911 | 3/1935 | Abrams | 294/19 A X |
| 2,204,482 | 6/1940 | Filipiak | 294/19 A |
| 2,658,785 | 11/1953 | Jones | 294/19 A |
| 2,681,822 | 1/1954 | Daniels | 294/99 R X |
| 3,462,184 | 8/1969 | Russell | 294/19 A |
| 3,547,477 | 12/1970 | Young | 294/19 A |
| 4,046,413 | 9/1977 | Jeninga | 294/19 A |

FOREIGN PATENT DOCUMENTS

| | | | |
|---|---|---|---|
| 476242 | 5/1929 | Fed. Rep. of Germany | 294/19 A |

*Primary Examiner*—Johnny D. Cherry
*Attorney, Agent, or Firm*—Polster, Polster & Lucchesi

[57] ABSTRACT

A golf ball retriever including an elongate handle and a ball gripping and retention device on one end of the handle wherein the gripping and retention device includes a base so sized as to have a width somewhat smaller than the diameter of a golf ball and a plurality of ball engaging loops of flexible, resilient wire or the like having one end cantilevered from the base and extending endwise from the sides of the base. The loops extend from the base a distance somewhat greater than the radius of a golf ball and are so positioned as to engage the golf ball to be picked up. The inner ends of the cantilevered loops are spaced apart a distance somewhat less than the diameter of the ball and the free or outer ends of the loops are spaced apart appreciably less than the diameter of the golf ball so that the ends of the loops upon engaging a golf ball to be picked up and upon the gripping and retention device being pushed onto the golf ball are forced apart by the golf ball. Upon the golf ball moving toward the base a distance greater than the radius of the ball, the outer ends of the loops spring back toward one another forcing the ball toward the base and holding the golf ball captive.

1 Claim, 6 Drawing Figures

GOLF BALL RETRIEVER

This is a continuation of application Ser. No. 009,862, filed Feb. 7, 1979, now abandoned.

BACKGROUND OF THE INVENTION

This invention relates to a golf ball retriever, and more particularly to a golf ball retriever having an extensible handle which when retracted allows a golfer to carry the retriever in his golf bag together with his clubs and which may be extended a considerable distance to permit the golfer to readily retrieve golf balls lost in water hazards or other difficult to reach places.

Devices for picking up golf balls have long been known. These devices have not met with any significant degree of commercial acceptance on account of any number of reasons. Certain of the prior art golf ball retrievers had fixed handles and thus, if they had any reach at all, were cumbersome to carry by the golf player. Other golf ball retrievers included movable latches or clasps which were expensive to manufacture and could become clogged with mud and other debris in picking up golf balls thus interfering with their operation. Still other retrievers require that the retriever be precisely placed on the ball and that the ball be on a relatively hard surface so that the retriever could be forcefully pushed onto the ball. Of course, in many instances such as at the bottom of a water hazard, a suitable hard surface was not available for satisfactory operation of these devices. Still further, other golf ball retrievers had intricately formed fingers which resiliently gripped the ball. These fingers were difficult and expensive to manufacture and could easily be bent during use of the retriever interfering with their operation. In addition, the golf ball engaging end of the prior art devices are considerably larger than the diameter of a golf ball, making their use impossible, as for example, when retrieval is attempted through a conventional chain link fence.

Reference may be made to such U.S. patents as U.S. Pat. Nos. 1,658,145, 3,462,184, 3,770,308, 4,046,413 and 4,073,529 which disclose various prior art golf ball retrieving devices in the same general field as the present invention.

The retriever described hereinafter overcomes the prior art deficiencies by providing a retriever construction sized to closely approximate the diameter of a golf ball. The free end of the ball engaging loops is slightly less than the ball diameter while the attached ends of the loops is slightly larger. This construction provides a spring force on the ball being retrieved such as to force the ball into the device as the loop ends pass the maximum ball dimension.

One of the objects of this invention is to provide a golf ball retriever which is light weight and of compact size and which has a telescopically extendible handle, thereby making it relatively easy for a golfer to carry in his golf bag.

Another object of this invention is to provide a golf ball retriever which may pick up a golf ball from any direction;

Another object of this invention is to provide a golf ball retriever which is self-centering on the golf ball.

Another object of this invention is to provide a golf ball retriever which requires a low force to grip a golf ball.

Another object of this invention is to provide a golf ball retriever in which the retrieving head may be rotated to any desired angle relative to the handle of the retriever.

Yet another object of this invention is to provide a golf ball retriever which is relatively easy and economical to manufacture and which can be sold to the golfer at an affordable price.

Another object of the invention is to provide a golf ball retriever which, upon engagement with the ball, will hold the ball securely to permit washing or cleaning the ball.

Yet another object of this invention is to provide a golf ball retriever which permits easy removal of the ball from the retriever.

Another object of this invention is to provide a golf ball retriever construction which automatically exerts a spring force on the ball during ball capture.

Other objects will be apparent to those skilled in the art in light of the following description and accompanying drawings.

SUMMARY OF THE INVENTION

In accordance with this invention, generally stated, a golf ball retriever includes an elongate handle and a ball gripping and retention means on the one end of the handle. The latter includes a base of rigid material which is preferably so sized as to have a width somewhat smaller than the diameter of a golf ball. A plurality of ball engaging loops of flexible, resilient wire or the like are attached to the base at one end and have a free second end. These loops extend out from the base a distance somewhat greater than the radius of a golf ball and are adapted to engage a golf ball to be retrieved. The free ends of the loops are spaced apart a distance less than the diameter of a golf ball so that upon the ends of the loops engaging the golf ball and upon the gripping and retention means being pushed onto the golf ball, the loops are forced apart independently of one another by the golf ball. Upon the golf ball moving toward the base a distance greater than the radius of a golf ball, the outer ends of the loops resiliently move toward one another so as to force the ball against the base and hold the golf ball captive.

BRIEF DESCRIPTION OF THE DRAWINGS

In the drawings.

Corresponding references characters indicate corresponding parts throughout the several views of the drawings.

DESCRIPTION OF PREFERRED EMBODIMENTS

Figure 1:
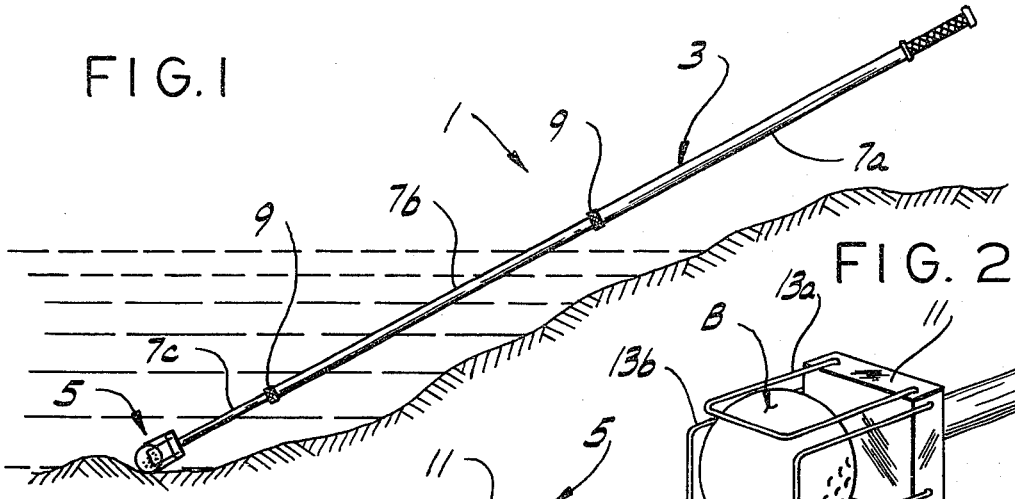
FIG. 1 is a view of a golf ball retriever of the present invention illustrating its telescopically extensible handle in an extended position with a retrieving head of the device engaging a golf ball on the bottom of a pond.

Referring now to the drawings and more particularly to FIG. 1, a golf ball retrieving device of this invention is indicated in its entirety by reference character 1. The device is shown to include a telescopically extensible handle 3 carrying a ball retrieving head 5 on the outermost end of the handle. More particularly, telescopically extensible handle 3 is shown to be a three piece member having handle segments *7a*, *7b* and *7c* which slide in and out relative to one another. The handle segments may be locked relative to one another in any desired position by means of locking nuts 9. Thus, the handle may be adjusted to any desired length and locked in that position so that the user of the ball retriever can exert an axial force with the handle without collapsing the handle. It will be understood, however, that other telescopic handles may be used which do not incorporate the above-described locking nuts, but rather which rely on friction or other means to hold the handle in its desired length. It is further to be understood that it is a particular attribute of the ball retrieving device of the present invention that the retrieving head does not require any substantial amount of axial force for operation and thus with many handle designs, it is not necessary to provide means for locking the handle in its extended position.

Figure 2:
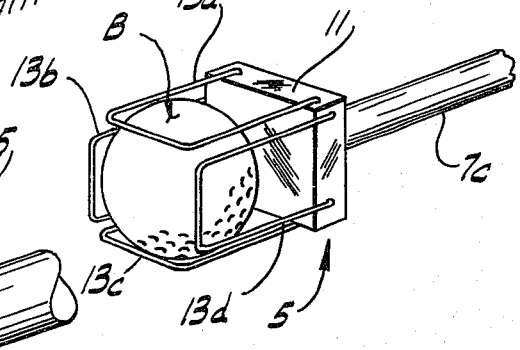
FIG. 2 is a perspective view of the retrieving head of the device.
Figure 3A:
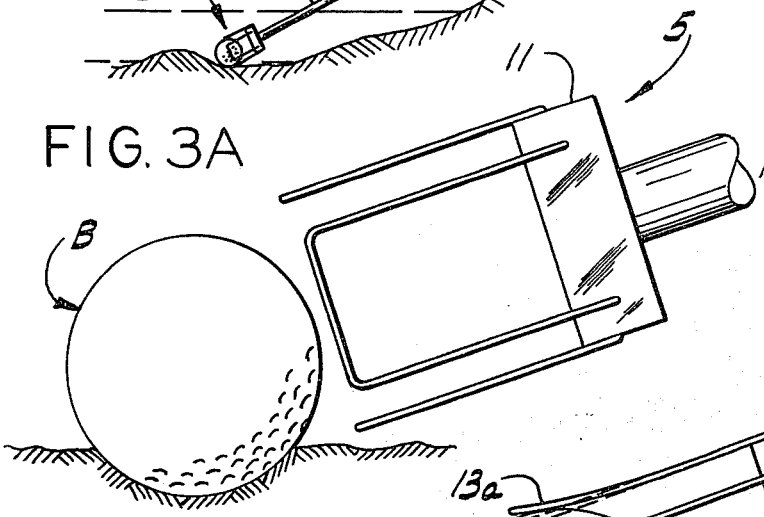
FIGS. 3A–3C illustrate the movement of the resilient loops or fingers of the retrieving head as a golf ball is picked up.

Referring now to FIG. 2, retrieving head 5 is shown to comprise a regular-sided polygonal base member (e.g., a square) 11 made of a rigid, resilient material, such as a suitable synthetic resin or the like. this base has a width approximately the same as the diameter D of a conventional golf ball B. As best shown in FIG. 3C, base 11 is preferably somewhat smaller than the diameter D of the golf ball. By so sizing head 5, it will be appreciated that the head will fit into virtually any opening (e.g., through an opening in an chain link fence) through which a golf ball will pass. It will be appreciated, however, that within the broader aspects of this invention that base member 11 may be of any desired shape (i.e., polygonal or circular) so long as the base is approximately the same size as (or somewhat smaller than) the diameter of a golf ball.

As indicated at 13*a*, 13*b*, 13*c* and 13*d*, a plurality of ball engaging loops or fingers of flexible, resilient wire or the like are secured to base 11 and extend endwise from the base with one loop on each side of the base. Each of these loops extends out from the base in a direction substantially parallel to the axis of handle 3 a distance somewhat greater than the radius R of golf ball B (see FIG. 3*c*). As shown in dotted lines in FIG. 3B, each of the loops assumes an unflexed position in which their outer ends are spaced apart a distance somewhat less than the diameter D of golf ball B. Of course, with the inner ends of the loops secured (embedded) in the sides of base 11, and with the latter preferably being only slightly smaller than the diameter of ball B, the inner ends of the loops are also spaced apart a distance slightly smaller than the diameter of ball B. Upon the ends of the loops engaging a golf ball B to be picked up and upon a slight axial pressure being applied to handle 3 so as to force the loops onto the golf ball, the golf ball cammingly engages the loops and resiliently forces them outwardly (as shown in solid lines in FIG. 3B) so that the outer ends of the loops engage the sides of the golf ball. Continued axial movement of the golf ball relative to retrieving head 5 causes the outer or free ends of the loops to move past the maximum diameter of the golf ball. In this position, the loops automatically exert a spring force on the ball. Thus the golf ball is drawn inwardly toward base 11 by the resilient biasing action of the loops. With the ball in its captured position (FIG. 3C), the resilient loops again assume their normal, unflexed positions and thus securely hold the golf ball captive between the loops and base 11. Of course, the weight of the ball is not sufficient to force open the loops. Thus, the ball may be readily picked up.

Figure 3B:
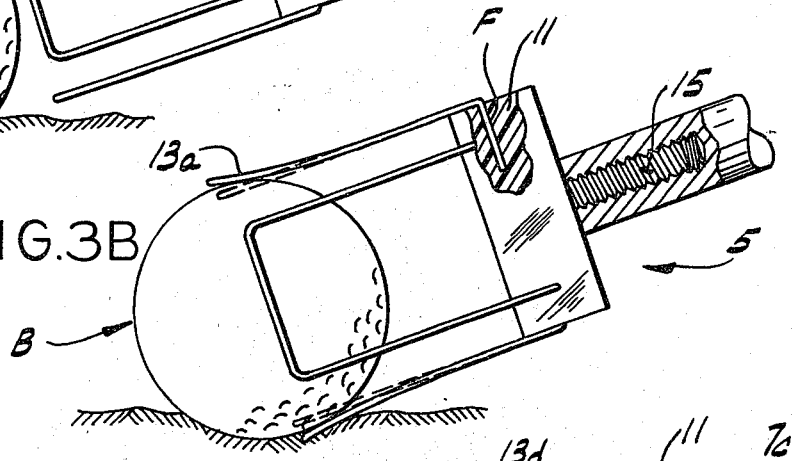
Figure 3C:
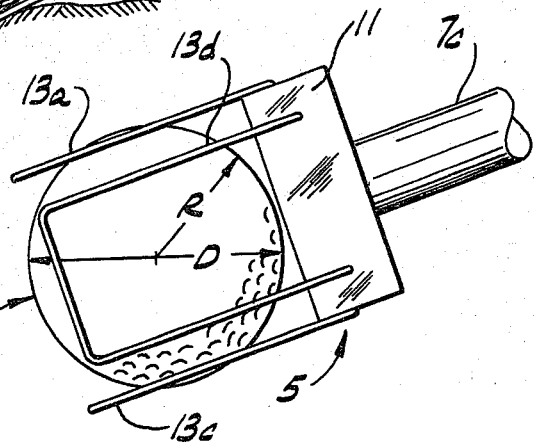

As shown in FIG. 3B, each retaining loop 13*a*–13*d* is a one-piece member of formed wire having two spaced apart legs and a base connecting the outer ends of the legs. The ends of the legs adjacent base 11 have feet F bent therefrom which extend inwardly toward the center of the base. Thus, it will be appreciated that the resilient fingers 13*a*–13*d* are identical to one another and are thus interchangeable and that these fingers may be readily and economically fabricated from suitable wire stock (preferably from spring steel wire stock) so as to have desired resilient characteristics. Upon manufacture of the retrieving device of the present invention, the four spring wire loops together with a threaded stud 15 for attachment of head 5 to handle 3 are molded-in-place in base 11. With feet F of the wire loops firmly embedded in base 11, the loops are resiliently cantilevered with respect to the base.

Figure 4:
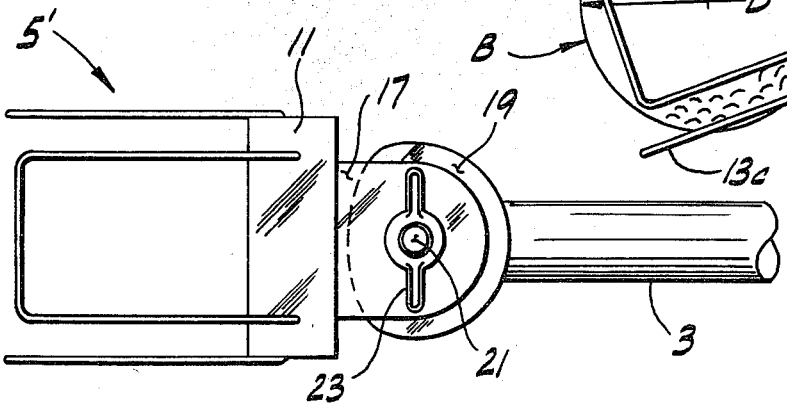
FIG. 4 is a side elevational view of an alternative embodiment of the retrieving head of the device of this invention whereby the retrieving head may be pivotally moved to any desired angular position and relative to the handle locked therein.

Referring now to FIG. 4, an alternative embodiment of the retrieving head of this invention is generally indicated at 5'. This retrieving head is substantially identical to retrieving head 5, as described above, except for the provision of a clevis fitting 17 secured to the rear face of base 11 which receives a lug 19 affixed on the end of handle 3. A threaded fastener 21 is inserted through a hole in the clevis and through another hole in the lug and threadably receives a wing nut 23 allowing the user of the retriever to pivotally move the retrieving head relative to the longitudinal center line of the handle to any desired angular position when the wing nut is loosened and to securely lock the retrieving head in this desired angular position upon tightening of the wing nut. In this manner, the head may be easily adjusted.

In accordance with this invention, it will be particularly noted that fingers or loops 13*a*–13*d* are preferably made of resilient spring wire and are of relatively large guage material. This permits them to be readily bent or flexed with relatively low application of force thereto so as to engage and capture a golf ball. Thus, only a relatively low axial force must be applied to the spring fingers to permit them to flex outwardly for reception of a golf ball. Also, it will be noted that the retrieving device of this invention is self-centering upon application of the retrieving fingers on a golf ball. That is, if the fingers do not uniformly engage the sides of a golf ball to be picked up the fingers will move the ball into a position in which it can be received by the retrieving head. Still further, it will be appreciated that not all of the fingers need be flexed in equal amount to receive a golf ball. These features, when combined, allow retrieving head 5 of the present invention to pick up a golf ball at a relatively low angle between handle 3 and the horizontal (i.e., retrieving head 5 need not be brought down vertically on the golf ball), such as is illustrated in FIGS. 1 and 3*a*.

In view of the above, it will be seen that the several objects and features of this invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

I claim:

1. A golf ball retriever comprising an elongate handle and a ball gripping and retention means on one end of the handle, said gripping and retention means including a base of a curable synthetic resin material being so sized as to have a width approximately the diameter of a golf ball, said base being of square shape when viewed from the end of the retriever, and four golf ball engaging loops of flexible, resilient, light gauge spring wire extending from the base in a direction generally parallel to the handle and being directly engageable with a golf ball to be retrieved, said loops each being a one-piece member having two spaced apart legs and an end portion connecting the outer ends of the legs, said legs and said end portion being substantially coplanar, said legs each having a respective foot at the other end thereof extending generally perpendicularly to the plane of said legs and said end portion, said feet being imbedded in said base thereby to rigidly cantilever mount said loop to said base, said loops being equally spaced around the base and being adapted to surround a golf ball to be picked up, said end portion of each of said loops being spaced from the base a distance somewhat greater than the radius of a golf ball but less than the diameter of a golf ball, said end portions of said loops on opposite sides of the base being spaced apart a distance somewhat less than the diameter of a golf ball and said loops being movable independently of one another upon said loops engaging said golf ball so that upon the end portions of said loops engaging a golf ball and upon the loops being pushed onto the golf ball, said loops being resiliently and readily forced apart by the golf ball and by the relatively low application of axial force to said handle and, upon the golf ball moving toward the base a distance greater than the radius of the golf ball, the end portions of the loops resiliently moving toward one another thereby to force the ball toward the base and to hold the ball captive between the loops and the base, said handle being telescopically extensible, said gripping and retention means being pivotal with respect to said handle, said retriever further including means for selectively locking said gripping and retention means in any desired angular position with respect to said handle.

* * * * *